US006607292B2

(12) United States Patent
Gutierrez et al.

(10) Patent No.: US 6,607,292 B2
(45) Date of Patent: Aug. 19, 2003

(54) ADJUSTMENT MECHANISM FOR LUMINAIRE

(75) Inventors: Anthony J. Gutierrez, Austin, TX (US); Robert L. Summerford, Schertz, TX (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/950,958

(22) Filed: Sep. 12, 2001

(65) Prior Publication Data

US 2002/0051361 A1 May 2, 2002

Related U.S. Application Data

(63) Continuation of application No. 09/542,786, filed on Apr. 5, 2000, now Pat. No. 6,290,376.

(51) Int. Cl.[7] ..... F21V 21/00
(52) U.S. Cl. ..... 362/371; 362/273; 362/463
(58) Field of Search ..... 362/523, 273, 362/289, 371, 428, 463

(56) References Cited

U.S. PATENT DOCUMENTS

| | | | |
|---|---|---|---|
| 1,633,837 A | 1/1927 | Youtz | |
| 2,166,394 A | 7/1939 | Crossley | |
| 3,505,515 A | 4/1970 | Adra | |
| 4,212,050 A | 7/1980 | Trenkler | |
| 4,319,313 A | 3/1982 | Eberhart et al. | |
| 4,333,131 A | 6/1982 | Hujimoto et al. | |
| 4,527,224 A | 7/1985 | Sangiamo et al. | |
| 4,623,956 A | 11/1986 | Conti | |
| 5,068,769 A | 11/1991 | Umeda et al. | |
| 5,339,234 A | 8/1994 | Russello et al. | |
| 5,613,766 A | 3/1997 | Raouf | |
| 5,642,934 A | 7/1997 | Haddad | |
| 5,647,659 A | 7/1997 | Mori | |
| 5,803,585 A | 9/1998 | Littman et al. | |
| 5,906,431 A | 5/1999 | Chianale et al. | |
| 6,290,376 B1 * | 9/2001 | Gutierrez et al. | 362/371 |

* cited by examiner

*Primary Examiner*—Stephen Husar
(74) *Attorney, Agent, or Firm*—John F. Salazar; James E. Cole; Middleton Reutlinger

(57) ABSTRACT

The present invention provides an adjustment mechanism by which a luminaire may be adjusted and secured along an arcuate path. The adjustment mechanism includes a mounting bracket, adjustment bolt, adjustment brace, which is attached to the optical housing of the luminaire, and a positioning means, such as an eyebolt. The adjustment bolt is threadably attached to the adjustment brace via a non-rotatable nut. The adjustment bolt, which is disposed through the positioning means, is turned in order to adjust the position of the luminaire. As the adjustment bolt turns, the non-rotatable nut, along with the adjustment brace and optical housing attached thereto, moves along the threaded shaft of the bolt. When the turning of the bolt has ceased, the non-rotatable nut, adjustment brace and optical housing are secured in position by the frictional engagement of the thread of the bolt and the thread of the nut.

24 Claims, 5 Drawing Sheets

ADJUSTMENT MECHANISM FOR LUMINAIRE

This is a continuation of application Ser. No. 09/542,786, which was filed on Apr. 5, 2000, now U.S. Pat. No. 6,290, 376 B1.

BACKGROUND

1. Field of the Invention

The present invention relates to lighting fixtures and, more particularly, to adjustment mechanisms for luminaire-type lighting fixtures.

2. Description of the Related Art

Wall mounted luminaire-type lighting fixtures are often designed to be tiltably adjusted. However, current luminaire adjustment mechanisms tend to be difficult to use. Current adjustment mechanisms often employ exterior rotatable knurled knobs that tend to be obtrusive and require that the luminaire be spaced from the wall in order to accommodate the adjustment mechanism. Some of these adjustment mechanisms also employ lubricating grease within its workings, which can produce an unsightly residue on and around the lighting fixture. Set screws or lock washers are often included in these current adjustment mechanisms to lock in place the optical housing of the fixture after adjustment. The use of such securing means requires multiple steps in adjusting and locking the fixture. They also often lead to imprecise adjustment, due to the tendency of the lighting fixture to shift as the securing means is tightened.

Thus, there is a need for an adjustment mechanism for a luminaire that provides for easy and precise adjustment, and is less obtrusive than current mechanisms. The novel adjustment mechanism should provide for the precise adjustment of the fixture by the use of a socket driver or other similar tool, without soiling the fixture. The mechanism should also maintain the luminaire in position once it has been so adjusted.

SUMMARY OF THE INVENTION

It is an object of the present invention to provide an adjustment mechanism for a luminaire.

It is another object of the present invention to provide an adjustment mechanism for a luminaire that allows for the adjustment and securing into position of a luminaire with one movement.

It is yet another object of the present invention to provide an adjustment mechanism for a luminaire that is cleaner and less obtrusive than many current mechanisms.

It is a further object of the present invention to provide an adjustment mechanism having a floating adjustment bolt that allows for the adjustment of the fixture along an arcuate path.

More particularly, an adjustment mechanism of the present invention includes a mounting bracket that attaches the lighting fixture to a wall, pole or similar structure. The mounting bracket includes a substantially arcuate support wall that includes at least one, and preferably three slots therein. An adjustment brace is also provided, which is fastened to the optical housing of the lighting fixture by at least one fastening means, such as a housing bolt. The fastening means, or housing bolt, is preferably disposed in one of the slots included in the mounting bracket, and is free to move along the course of the slot, thereby allowing the adjustment brace and the optical housing to move relative to the mounting bracket. Attached to the adjustment brace is a non-rotatable threaded nut, through which a threaded adjustment bolt is received. The non-rotatable nut is free to move along at least a portion of the threaded length of the adjustment bolt, as the adjustment bolt is axially rotated. The shaft of the adjustment bolt is also disposed through a positioning means, such as an eyebolt, which is attached to the mounting bracket. At least one securing means, such as a washer, nut or combination of both, is attached to the adjustment bolt. The securing means restricts the movement of the adjustment bolt so that the bolt remains in position as the non-rotatable bolt moves along its shaft.

In use, the optical housing may be adjusted relative to the mounting bracket by axially rotating the adjustment bolt, preferably with a socket driver or other similar tool. As the adjustment bolt is rotated, a mechanical advantage is gained by the presence of the positioning and securing means, which act to restrict the movement of the bolt. More specifically, the adjustment bolt remains in position as it is turned, while the non-rotatable nut is able to move along the shaft of the rotating bolt. The adjustment and optical housing brace move with the non-rotatable nut. The adjustment bolt has enough room to shift within the eyelet of the eyebolt, so that the shaft's angle of inclination shifts with the non-rotatable nut as the nut and the adjustment brace move along the arched support wall of the mounting bracket. Also, the non-rotatable nut is movably attached to the adjustment brace so that the nut may "float" as it moves along the arched support wall. The housing bolts connecting the optical housing to the adjustment brace move, in conjunction with the adjustment brace, along the slots of the mounting bracket. The optical housing, in turn, moves, along the same arc, defined by the support wall of the mounting bracket, as the housing bolts do, thereby providing for the adjustment of the light emanating from the optical housing. When the optical housing has been adjusted to the desired position, the fixture may be locked into position simply by stopping the rotation of the adjustment bolt. The frictional interaction of the thread of the non-rotatable nut and the thread of the adjustment bolt prevent any further movement of the optical housing.

It will become apparent that other objects and advantages of the present invention will be obvious to those skilled in the art upon reading the detailed description of the preferred embodiment set forth hereinafter.

DESCRIPTION OF THE PREFERRED EMBODIMENT

Figure 1:
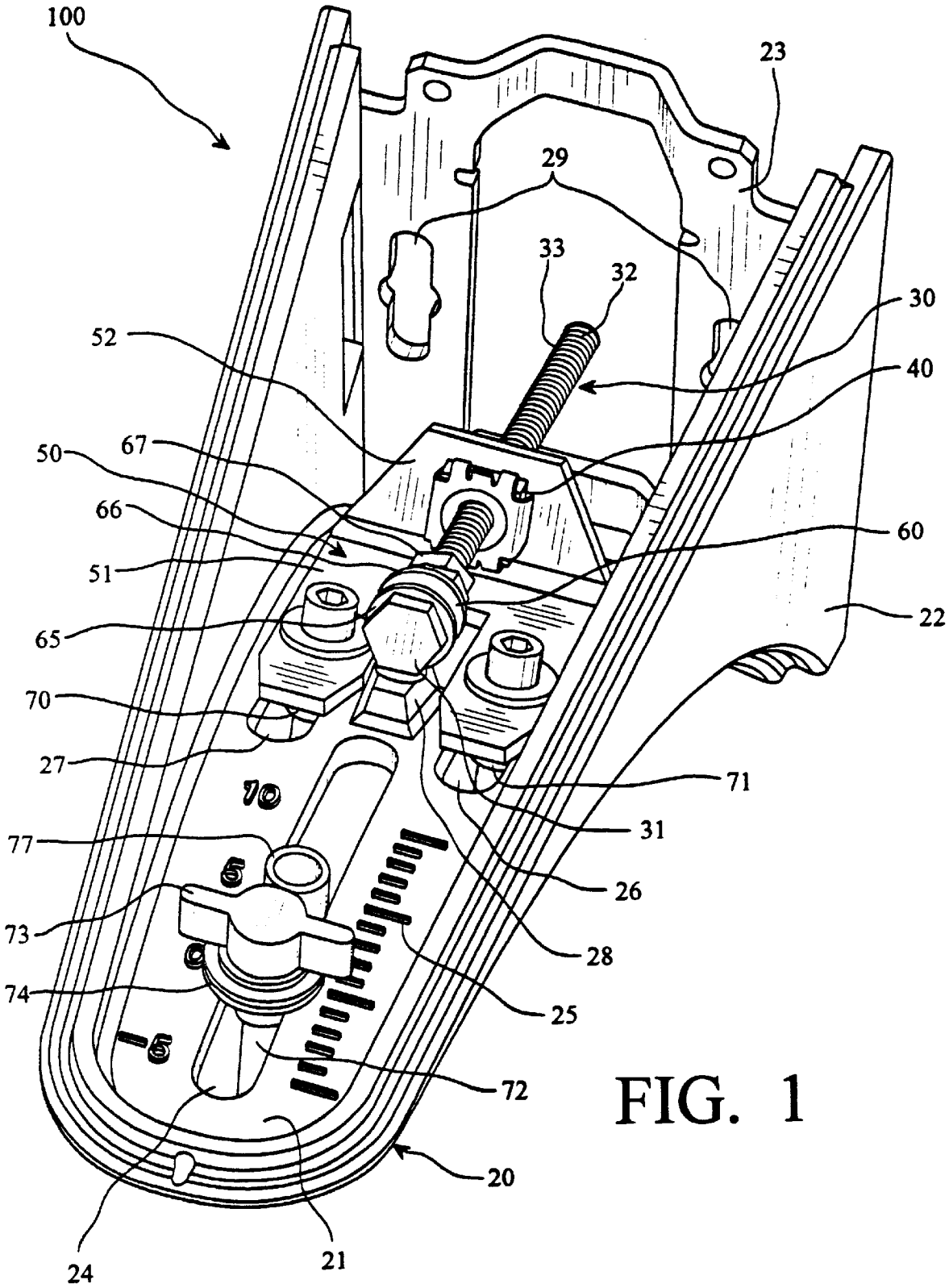
FIG. 1 is a perspective view of a preferred embodiment of an adjustment mechanism for a luminaire of the present invention.

As shown in the figures, an adjustment mechanism 100 for a luminaire is provided. The adjustment mechanism 100 includes a mounting bracket 20, an adjustment brace 50 attached to a non-rotatable nut 40, an adjustment bolt 30, a positioning means, such as an eyebolt 60, at least one securing means, such as washers 65 and 66 and nut 67, and at least one fastening means, such as housing bolts 70 and 71.

As shown in FIG. 1, the mounting bracket 20 has a mounting wall 23 that may include at least one hole 29 through which a screw or other fastening device may be disposed, so as to mount the luminaire to a wall, pole or similar structure. In the preferred embodiment, the mounting bracket 20 has a substantially arcuate support wall 21 and at least one substantially arcuate side wall 22. The support wall 21 has at least one slot 24 included therein, and preferably three slots 24, 26 and 27. Indicia may be included on the support wall that aids in the precise adjustment of the lighting fixture. For example, a scale 25 may be included on the support wall adjacent one of the slots 24, so that the degree of rotation of the optical housing 200 may be determined.

Also shown in FIG. 1, the adjustment brace 50 is positioned adjacent to the support wall 21 of mounting bracket 20. The adjustment bracket has a first wall 51, which may be generally U-shaped, that includes at least one hole therein. Extending from the first wall 51 of adjustment brace 50, preferably at a right angle therefrom, is a second wall 52 that may include a hole or slot therein. This second wall 52 may receive therein, or have attached thereto, a non-rotatable nut 40. The non-rotatable nut 40 includes an inwardly threaded annular portion through which the shaft 32 of adjustment bolt 30 is threaded. The non-rotatable nut 40 may include a flange projecting therefrom by which the nut 40 may be attached to the second wall 52 of the adjustment brace 50.

The hole(s) included in the first wall 51 of adjustment brace 50 are aligned so that they may receive at least one housing bolt 70 and 71. The shafts of housing bolts 70 and 71 are disposed through the slots 26 and 27 of the support wall 21 of the mounting bracket 20, as well as through the holes located in the adjustment brace 50. The housing bolts 70 and 71 are attached to the optical housing 200, so that the housing bolts 70 and 71 attach the adjustment brace 50, the mounting bracket 20 and the optical housing 200 together, while allowing the optical housing 200 and the adjustment brace 50 to move with each other relative to the mounting bracket 20, as will be explained hereinafter.

An additional housing bolt 72 may also be attached to optical housing 200 and be disposed through a third slot 24 located in support wall 21. Unlike housing bolts 70 and 71, housing bolt 72 is not attached to adjustment brace 50. Rather, housing bolt 72 may include an angle indicator 73 and/or at least one washer 74 attached thereto, which thereby secure optical housing 200 to mounting bracket 20. The wing portions of angle indicator 73 may be aligned so that they may be used as an indicating means by which the position of the optical housing 200 may be judged according to the scale 25 located on the support wall 21. Other indicating means may also be provided which moves with optical housing 200 and serves to indicate the angle of adjustment of the housing. In the preferred embodiment, the scale 25 will be aligned adjacent to slot 24, so that the position of the angle indicator 73 may be compared to the scale 25 to determine the angle of adjustment of the optical housing 200. The scale may include markings representing degrees of adjustment away from an initial position marked 0. In the preferred embodiment, the optical housing 200 may be adjusted up to 10 degrees away from or up to 5 degrees toward the mounting surface of the structure upon which the lighting fixture is mounted. However, a wider range of adjustment is contemplated by the adjustment mechanism of the present invention.

Figures 2, 3:
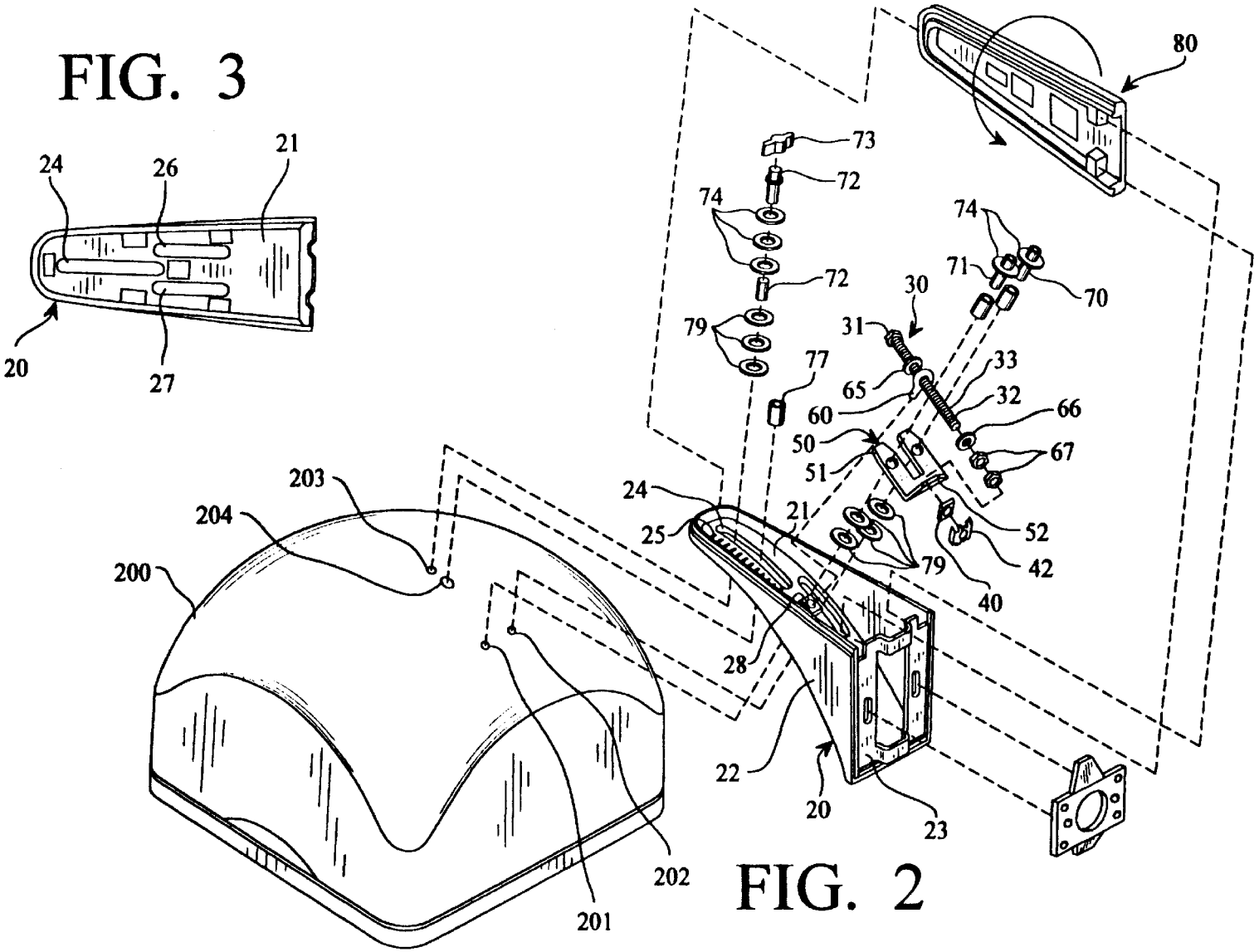
FIG. 2 is an exploded view of a luminaire including the adjustment mechanism of FIG. 1.
FIG. 3 is a bottom view of the mounting bracket of the adjustment mechanism of FIG. 1.

As shown in FIG. 2, the mounting bracket 20 is attached to the optical housing 200 of the lighting fixture by the housing bolts 70, 71 and 72 that are disposed through both the slots 24, 26 and 27 located in the support wall 20 and a plurality of holes 201, 202 and 203 located in the optical housing 200. Adjustment brace 50 is situated with the first wall 51 disposed adjacent to support wall 21, while the second wall 52 projects therefrom and is generally perpendicular to support wall 21. Non-rotatable nut 40 is attached to the second wall 52 by a flange 42, as shown in FIG. 2, or similar means. Non-rotatable nut is so aligned as to receive the shaft 32 of adjustment bolt 30. In the preferred embodiment, adjustment bolt 30 includes a thread 33 circumscribing a portion of shaft 32. Thread 33 mates with the threaded annular portion of non-rotatable nut 40.

A positioning means, such as eyebolt 60, is disposed within support wall 21. The eyebolt 60 receives the shaft of adjustment bolt 30. The eyelet of eyebolt 60 projects away from support wall 21 and is aligned perpendicular to the length of slots 24, 26 and 27. Securing means are disposed on either side of eyebolt 60 along the shaft 32 of adjustment bolt 30. More particularly, washer 65 is disposed between the head 31 of adjustment bolt 30 and the eyelet of eyebolt 60, while washer 66 and nut(s) 67 are disposed between the eyelet and non-rotatable nut 40. These securing means restrict the longitudinal movement of adjustment bolt 30.

A cover 80 is also shown in FIG. 2. Cover 80 fits over the adjustment mechanism 100 and attaches to the upper edge of sidewall 22. A plurality of washers 74 and spring washers 79 are disposed along the shafts of housing bolts 70, 71 and 72. The washers 74 are used to adjust the spacing between the various components of the lighting fixture and also assist in securing these components to each other. The spring washers 79 are partially compressible and thereby provide for a smoother adjustment of the optical housing 200.

A cylindrical tube 77 may be disposed through both hole 204, located in optical housing 200, and slot 24 located in the support wall 21 of mounting bracket 20. This cylindrical tube 77 may receive the electrical conductors leading to the optical housing 200.

FIG. 3 shows the underside of mounting bracket 20 with slots 24, 26 and 27 located in support wall 21. In the preferred embodiment, slots 26 and 27, through which housing bolts 70 and 71 are disposed, are aligned parallel to each other, while slot 24 is spaced parallel to, but spaced apart from slots 26 and 27.

Figure 4:
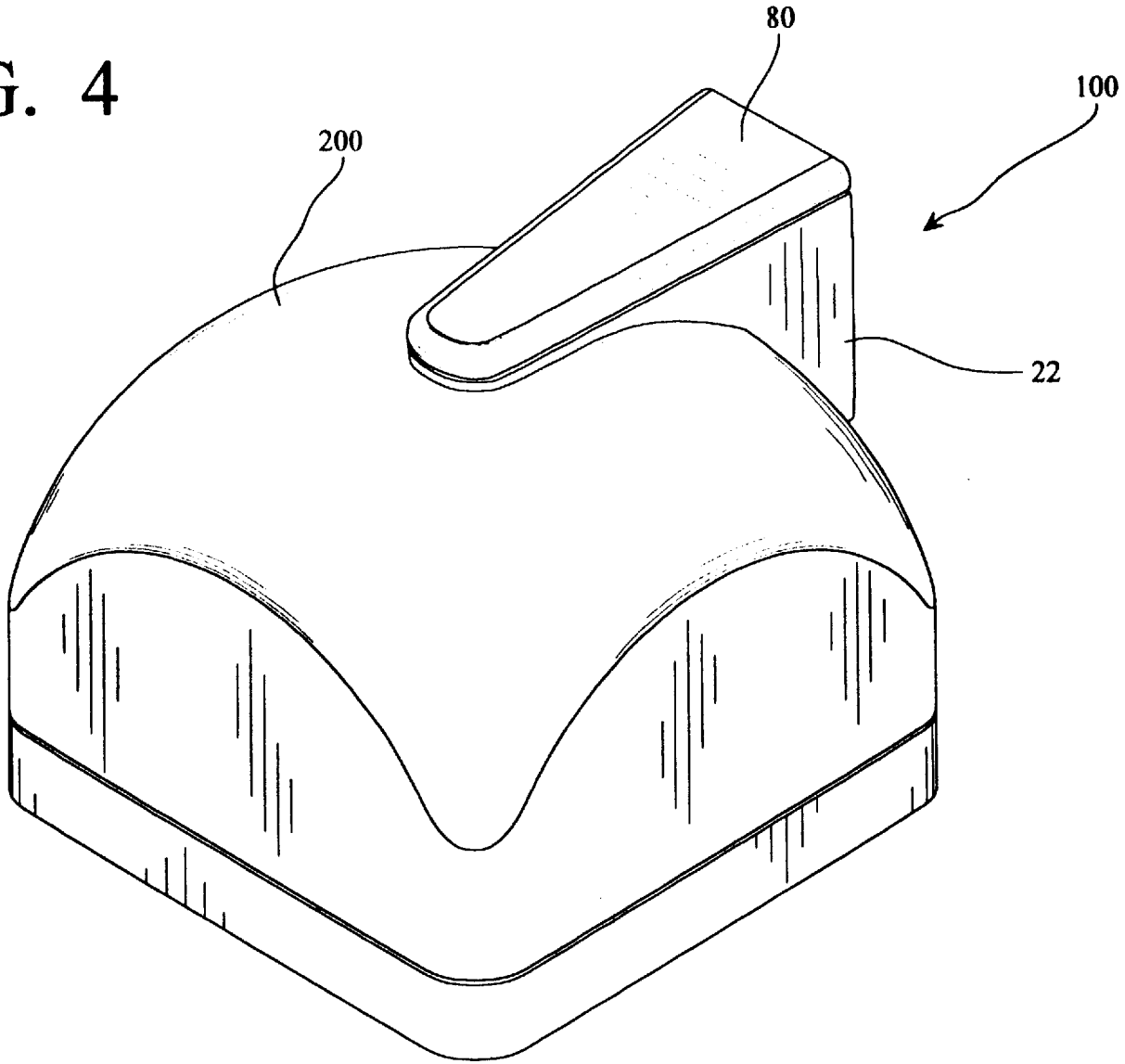
FIG. 4 is a perspective view of the luminaire of FIG. 2.
Figure 5:
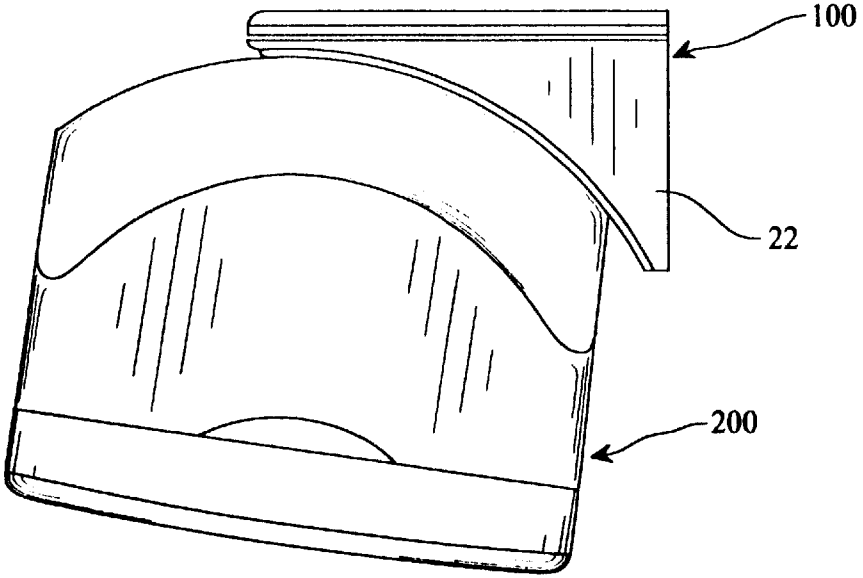
FIG. 5 is a side view of the luminaire of FIG. 3 shown with the optical housing adjusted away from the mounting surface.
Figure 6:
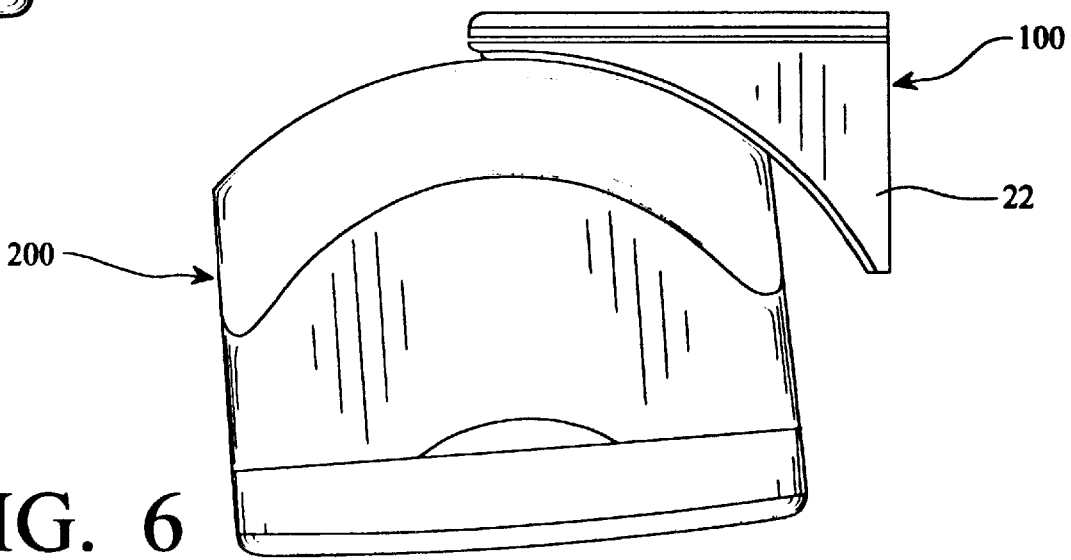
FIG. 6 is another side view of the luminaire of FIG. 3 shown with the optical housing adjusted toward the mounting surface.

FIGS. 4–6 show a luminaire with the adjustment mechanism 100 of the present invention. FIG. 4 shows the optical housing 200 directed parallel to a mounting surface, or, rather, at 0° of adjustment. FIG. 5, however, shows the optical housing 200 directed 10° away from the mounting surface. FIG. 6, on the other hand, shows the optical housing adjusted 5° toward the mounting surface. In the preferred embodiment, the adjustment mechanism 100 allows positioning of the optical housing 200 at any point with a range of 10° away from or 5° toward the mounting surface.

Figure 9:
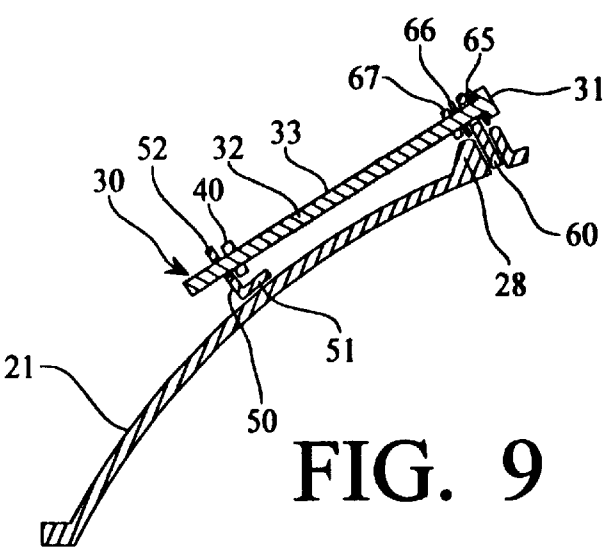
FIG. 9 is yet another cross-sectional view of the selected elements of FIG. 7, wherein the adjustment brace is adjusted away from the head of the adjustment bolt.
Figure 8:
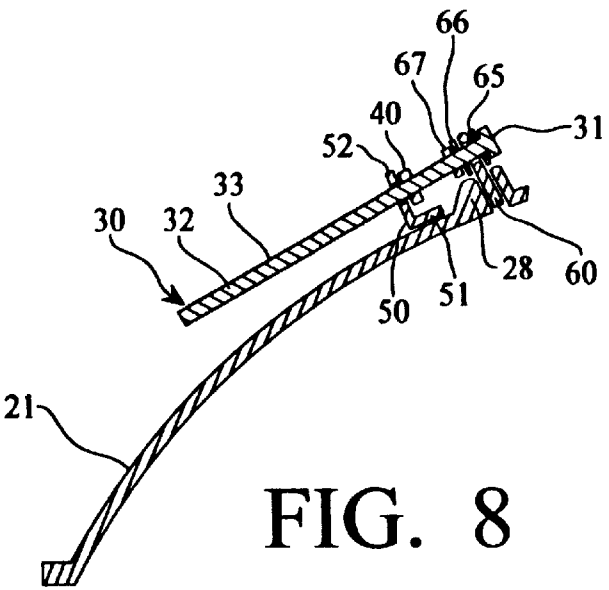
FIG. 8 is another cross-sectional view of the selected elements of FIG. 7, wherein the adjustment brace is adjusted toward the head of the adjustment bolt.
Figure 7:
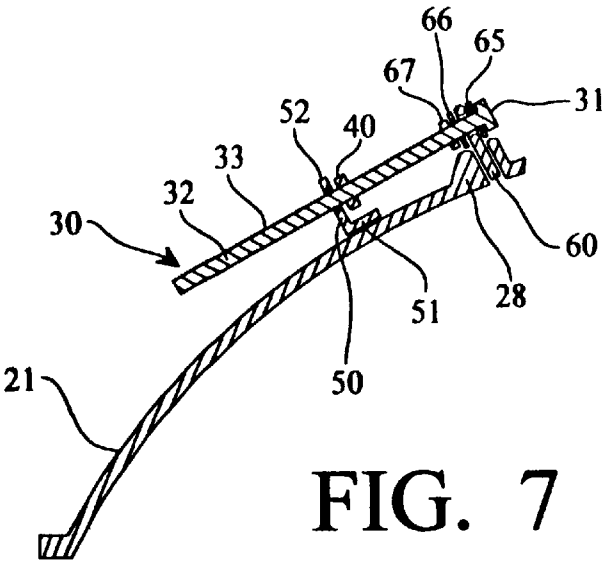
FIG. 7 is a cross-sectional view of selected elements of the adjustment mechanism of FIG. 1, namely, a portion of the support wall of the mounting bracket, the non-rotatable nut, the adjustment brace, the adjustment screw, the securing means, and the eyebolt.

As shown in FIGS. 7–9, the shaft 32 of adjustment bolt 30 moves relative to support wall 21 of mounting bracket 20 as the adjustment mechanism 100 is adjusted. More particularly, since the support wall 21 is arcuate and the adjustment brace 50 moves in the arc defined by slots 26 and 27 located in the support wall 21, the adjustment bolt 30 shifts or floats to accommodate the change in position of the adjustment brace 50 and the non-rotatable nut 40 attached thereto. As the optical housing 200 is adjusted along the arched support wall 21, the eyelet of eyebolt 60 remains stationary. During the adjustment, the adjustment bolt 30 shifts or floats within the eyelet of eyebolt 60, while the non-rotatable nut 40 floats relative to adjustment brace 50. The shifting of both the adjustment bolt 30 and the non-rotatable nut 40 allows for movement of the adjustment brace 50 along the arched support wall 21, while the non-rotatable nut 40 moves along the shaft 32 of adjustment bolt 30.

In use, the cover 80 is removed from the adjustment mechanism 100. A socket driver, screwdriver or other similar tool is mated to the head 31 of adjustment bolt 30. Adjustment bolt 30 can thereby be axially rotated. The securing means 65, 66, 67 prevent adjustment bolt 30 from moving longitudinally. Instead, non-rotatable nut 40, which is threadably engaged to thread 33, moves along shaft 32. The inter-attachment of non-rotatable nut 40, adjustment brace 50, housing bolts 70 and 71 and optical housing 200 cause these aforementioned components to move along an arc defined by the slots 26 and 27 located in support wall 21 of mounting bracket 20, as the adjustment bolt 30 is rotated. Housing bolt 72 also moves in unison with these components, and the indicting means attached thereto may be used to determine the angle of inclination of the optical housing 200 by comparing it to the indicia, or scale 25, located on the support wall 21. When the proper angle has been attained, the rotation of adjustment bolt 30 is stopped. Thread 33 of adjustment bolt 30 frictionally engages the thread of non-rotatable nut 40, so that the optical housing 200 is locked in place. Thus, no additional locking means need be provided to secure the fixture in position, once it has been adjusted.

The components of the adjustment mechanism 100 may be formed of any metal and/or plastic well known in the art and by any method of manufacture well known in the art.

While the invention has been found in one preferred embodiment in respect to the design of the adjustment mechanism of the luminaire-type lighting fixture, it is apparent that various modifications can be made to the present invention without departing from

What is claimed is:

1. A luminaire adjustment mechanism, comprising:

a mounting bracket having a substantially arcuate support wall;

an optical housing slidably engaged with said arcuate support wall;

an adjustment bolt rotatably received by a non-rotatable nut;

said non-rotatable nut being attached to an adjustment brace;

said adjustment brace slidably attached to said mounting bracket and being connected to said optical housing.

2. The luminaire adjustment mechanism of claim 1, wherein said adjustment bolt and non-rotatable nut are floatably retained in said adjustment brace.

3. The luminaire adjustment mechanism of claim 1, wherein said mounting bracket includes first, second, and third slots in said arcuate support wall.

4. The luminaire adjustment mechanism of claim 3, further comprising an indicia for measuring adjustment of said optical housing.

5. The luminaire adjustment mechanism of claim 4, wherein said indicium is adjacent to said third slot.

6. The luminaire adjustment mechanism of claim 5, further comprising a housing bolt extending through said third slot and having an angle indicator disposed adjacent to and in cooperation with said indicia.

7. The luminaire adjustment mechanism of claim 1, wherein said adjustment brace includes a substantially U-shaped first wall having at least one hole therein and a second wall extending at a right angle therefrom.

8. The luminaire adjustment mechanism of claim 7, said non-rotatable nut being attached to said second wall of said adjustment brace.

9. The luminaire adjustment mechanism of claim 7, further comprising at least one housing bolt extending through said first wall, and said third slot in said mounting bracket, and affixed to said optical housing.

10. The luminaire adjustment mechanism of claim 1, said adjustment bolt being disposed through an eyebolt fixedly attached to said mounting bracket.

11. The luminaire adjustment mechanism of claim 1, further comprising a cylindrical tube extending upward from said optical housing through a third slot in said mounting bracket.

12. A luminaire adjustment mechanism, comprising:

a mounting bracket having a substantially arcuate support wall having at least one slot therein;

an adjustment brace slidably connected through said at least one slot to an optical housing;

an adjustment bolt threadably received through a non-rotatable nut affixed to said adjustment brace;

said adjustment bolt being disposed through a positioning mechanism fixedly attached to said mounting bracket;

wherein said adjustment bolt and said non-rotatable nut float relative to said adjustment brace.

13. The luminaire adjustment mechanism of claim 12, wherein said mounting bracket includes a first, a second, and a third slot therein.

14. The luminaire adjustment mechanism of claim 12, further comprising an indicia adjacent said third slot for measuring adjustment of said optical housing.

15. The luminaire adjustment mechanism of claim 12, wherein said adjustment brace includes a substantially U-shaped first wall having a first and a second hole therein and a second wall extending at a right angle from said first wall.

16. The luminaire adjustment mechanism of claim 15, wherein said adjustment bolt extends through said second wall of said adjustment brace.

17. A luminaire adjustment mechanism, comprising:

a mounting bracket having an arcuate support wall;

an adjustment bolt within said mounting bracket and above said arcuate support wall and extending through an adjustment brace and received by a non-rotatable nut;

at least one housing bolt extending through said adjustment brace and through at least one slot in said mounting bracket;

at least one housing bolt connected to an optical housing.

18. The luminaire adjustment mechanism of claim 17, wherein said mounting bracket includes three slots therein and further comprises a scale adjacent one of said three slots for measuring angular displacement of said optical housing.

19. The luminaire adjustment mechanism of claim 18, further comprising a housing bolt extending through one of said slots and having an angle indicator in cooperation with said indicia.

20. The luminaire adjustment mechanism of claim 19, further comprising an eyebolt attached to said arcuate support wall, said adjustment bolt being disposed through said eyebolt.

21. The luminaire adjustment mechanism of claim 20, wherein said arcuate support wall includes a first slot, a second slot, and a third slot, said first slot and said second slot each receiving a housing bolt therethrough and said third slot receiving a housing bolt and said angle indicator.

22. The luminaire adjustment mechanism of claim 21, further comprising a wiring tube from within said mounting tube to said optical housing.

23. A luminaire adjustment mechanism, comprising:

a mounting bracket having a substantially arcuate support wall;

an optical housing slidably engaged with said arcuate support wall;

an adjustment bolt rotatably received by a non-rotatable nut;

said non-rotatable nut being attached to an adjustment brace;

said adjustment brace slidably engaged to said mounting bracket and being connected to said optical housing;

wherein said adjustment bolt and non-rotatable nut float relative to said adjustment brace and further wherein said mounting bracket includes three slots therein;

said adjustment brace including a substantially U-shaped first wall having at least one hole therein and a second wall extending at a right angle therefrom;

an indicia for measuring adjustment of said optical housing, said indicia being adjacent one of said three slots;

an angle indicator disposed adjacent to and in cooperation with said indicia.

24. A luminaire adjustment mechanism, comprising:

a mounting bracket having a substantially arcuate support wall;

an optical housing slidably engaged with said arcuate support wall;

a worm rotatably received by a worm gear;

said worm gear being fixedly attached to an adjustment brace and said worm extending through an adjustment brace;

said adjustment brace slidably engaging said arcuate wall support and being operably connected to said optical housing;

said arcuate wall support further comprising an indicia for measuring adjustment of said optical housing and three slots therein;

wherein said indicia are located adjacent on of said three slots.

* * * * *